US011571040B2

(12) United States Patent
Kohatsu et al.

(10) Patent No.: US 11,571,040 B2
(45) **Date of Patent: *Feb. 7, 2023**

(54) WOVEN FOOTWEAR UPPER WITH INTEGRATED TENSILE STRANDS

(71) Applicant: NIKE, Inc., Beaverton, OR (US)

(72) Inventors: Shane S. Kohatsu, Portland, OR (US); Frederick J. Dojan, Vancouver, WA (US); Brandon Workman, Beaverton, OR (US)

(73) Assignee: NIKE, Inc., Beaverton, OR (US)

( * ) Notice: Subject to any disclaimer, the term of this patent is extended or adjusted under 35 U.S.C. 154(b) by 302 days.

This patent is subject to a terminal disclaimer.

(21) Appl. No.: 16/918,804

(22) Filed: Jul. 1, 2020

(65) Prior Publication Data

US 2020/0329818 A1 Oct. 22, 2020

Related U.S. Application Data

(63) Continuation of application No. 15/006,697, filed on Jan. 26, 2016, now Pat. No. 10,743,617.

(Continued)

(51) Int. Cl.

| | |
|---|---|
| ***A43B 23/02*** | (2006.01) |
| ***A43C 1/00*** | (2006.01) |
| ***A43B 1/04*** | (2022.01) |

(52) U.S. Cl.

CPC ..... *A43B 23/0205* (2013.01); *A43B 1/04* (2013.01); *A43B 23/0265* (2013.01); *A43C 1/00* (2013.01)

(58) Field of Classification Search

CPC ... A43B 23/0205; A43B 23/0265; A43B 1/04; A43B 23/00; A43B 23/0245;

(Continued)

(56) References Cited

U.S. PATENT DOCUMENTS 1,829,299 A 10/1931 Charles
2,144,689 A * 1/1939 Roberts ..... A43C 11/002 139/421

(Continued)

FOREIGN PATENT DOCUMENTS

CN 104185431 A 12/2014
EP 2792264 A2 10/2014

*Primary Examiner* — F Griffin Hall
(74) *Attorney, Agent, or Firm* — Shook, Hardy & Bacon L.L.P.

(57) ABSTRACT

Aspects hereof relate to a footwear upper formed from a plurality of tensile strands interwoven with a webbing material. The upper may have a bootie configuration. At least a portion of the strands may extend between a lateral-side portion of the upper and a medial-side portion of the upper and extend over an instep region and/or a sole region of the upper. The tensile strands may be bundled such that a plurality of strands forms a single weft or warp. Bundles having differing quantities of tensile strands may form a pattern on the upper that is effective for aiding conformance of the upper to a wearer's foot while enhancing ventilation and reducing water saturation. The tensile strands, whether singular or bundled, may be effective for transferring a load of a fastening mechanism through the woven upper while allowing the upper to have a desired degree of elasticity, support and/or comfort.

16 Claims, 3 Drawing Sheets

Related U.S. Application Data

(60) Provisional application No. 62/107,887, filed on Jan. 26, 2015.

(58) Field of Classification Search
CPC . A43B 23/025; A43B 23/027; A43B 23/0275; A43B 7/08; A43B 23/04; A43B 23/0247; A43B 1/14; A43C 1/00
USPC ..... 36/49, 50.1, 51
See application file for complete search history.

(56) References Cited

U.S. PATENT DOCUMENTS

| | | | |
|---|---|---|---|
| RE21,392 | E | 3/1940 | Hururt |
| D164,847 | S | 10/1951 | Dronoff |
| 3,822,727 | A | 7/1974 | Small et al. |
| 4,232,458 | A | 11/1980 | Bartels |
| 4,334,556 | A | 6/1982 | Froehlich et al. |
| 4,354,532 | A | 10/1982 | Tsubata |
| 6,506,697 | B1 | 1/2003 | Samel |
| 7,444,768 | B2 | 11/2008 | Friton |
| 9,091,002 | B2 | 7/2015 | Malloy et al. |
| 9,163,340 | B2 | 10/2015 | Vahhabaghai et al. |
| 9,681,708 | B2 | 6/2017 | Greene et al. |
| 10,743,617 | B2 * | 8/2020 | Kohatsu ..... A43B 23/0205 |
| 2005/0284002 | A1 | 12/2005 | Aveni |
| 2008/0022553 | A1 | 1/2008 | Mcdonald et al. |
| 2010/0107346 | A1 | 5/2010 | Aveni |
| 2010/0107443 | A1 | 5/2010 | Aveni |
| 2011/0041359 | A1 | 2/2011 | Dojan et al. |
| 2013/0055590 | A1 | 3/2013 | Mokos |
| 2013/0139329 | A1 | 6/2013 | Ferniani et al. |
| 2014/0173934 | A1 | 6/2014 | Bell |
| 2014/0202034 | A1 | 7/2014 | Vanatta |
| 2014/0223699 | A1 | 8/2014 | Tsuzuyama |
| 2014/0237854 | A1 | 8/2014 | Fallon |
| 2014/0237861 | A1 | 8/2014 | Podhajny |
| 2014/0338222 | A1 | 11/2014 | Song |
| 2015/0104592 | A1 | 4/2015 | Itoi |
| 2015/0272274 | A1 | 10/2015 | Berns et al. |
| 2015/0361599 | A1 | 12/2015 | Minor |
| 2016/0286898 | A1 | 10/2016 | Manz et al. |
| 2016/0309843 | A1 | 10/2016 | Song et al. |

* cited by examiner

WOVEN FOOTWEAR UPPER WITH INTEGRATED TENSILE STRANDS

CROSS-REFERENCE TO RELATED APPLICATIONS

This application is a Continuation Application of U.S. application Ser. No. 15/006,697 titled "Woven Footwear Upper With Integrated Tensile Strands," filed Jan. 26, 2016, which in turn claims priority to U.S. Provisional Patent Application No. 62/107,887 titled "Woven Footwear Upper with Integrated Tensile Strands," filed Jan. 26, 2015, the entireties of which are incorporated by reference herein.

BACKGROUND

Articles of footwear generally include two major components: an upper and a sole structure. The upper is often formed from a plurality of material elements (e.g., textiles, polymer sheet layers, foam layers, leather, and synthetic leather) that are stitched or adhesively bonded together to form an enclosure for comfortably and securely receiving a wearer's foot. More particularly, the upper forms a structure that extends over instep and toe areas of the wearer's foot, along medial and lateral sides of the foot, and around a heel area of the foot. The upper may also incorporate a fastening mechanism to adjust the fit of the footwear, as well as to permit entry and removal of the foot from the enclosure. The sole is generally secured to a lower portion of the upper and is primarily positioned between a wearer's foot and the ground. The sole may be designed to absorb the shock as the shoe contacts the ground and other surfaces.

SUMMARY

Aspects of the present invention relate to a footwear upper that includes a webbing material and a plurality of tensile strands interwoven at an orthogonal direction with respect to one another. The tensile strands may have a greater tensile strength and/or lower modulus of elasticity than the webbing material. The tensile strands may have a circular cross-section and the webbing material may have a non-circular cross-section. The tensile strands may be strategically positioned on the woven upper to aid conformance of the upper to a wearer's foot while enhancing ventilation and reducing water saturation from external factors and/or bodily fluids produced, for instance, during strenuous athletic activity. The tensile strands may permit portions of the upper to remain substantially in place during activity while simultaneously permitting portions of the footwear upper that are void of tensile strands to move away from firm contact with the wearer's foot thus decreasing fluid absorption and consequently the weight of the upper due to water saturation. The tensile strands may be grouped into bundles that collectively form a single weft or warp. The tensile strands, whether singular or bundled, may be effective for transferring a load of a fastening mechanism through the woven upper while allowing the upper to have a desired degree of elasticity, support and/or comfort.

Aspects of the present invention relate to a footwear upper that is formed from a plurality of tensile strands interwoven with a webbing material. The footwear upper may have a bootie configuration. At least a portion of the tensile strands may extend between a lateral-side portion of the footwear upper and a medial-side portion of the footwear upper and extend over an instep region and/or a sole region of the upper. The tensile strands may be bundled or grouped such that a plurality of tensile strands forms a single weft or warp. Bundles having differing quantities of tensile strands may form a pattern on the footwear upper that is effective for aiding conformance of the footwear upper to a wearer's foot while enhancing ventilation and reducing water saturation. The tensile strands, whether singular or bundled may be effective for transferring a load of a fastening mechanism through the woven upper while allowing the upper to have a desired degree of elasticity, support and/or comfort.

This Summary is provided to introduce a selection of concepts in a simplified form that are further described below in the Detailed Description. This Summary is not intended to identify key features or essential features of the claimed subject matter, nor is it intended to be used as an aid in determining the scope of the claimed subject matter.

BRIEF DESCRIPTION OF THE SEVERAL VIEWS OF THE DRAWINGS

Illustrative embodiments of the present invention are described in detail below with reference to the attached drawing figures, which are incorporated by reference herein and wherein.

DETAILED DESCRIPTION

The subject matter of embodiments of the present invention is described with specificity herein to meet statutory requirements. However, the description itself is not intended to limit the scope of this patent. Rather, the inventor has contemplated that the claimed subject matter might also be embodied in other ways, to include different elements or combinations of elements similar to the ones described in this document, in conjunction with other present or future technologies.

Aspects of the present invention relate to a footwear upper that includes a webbing material and a plurality of tensile strands interwoven at an orthogonal direction with respect to one another. The tensile strands may have a greater tensile strength and/or lower modulus of elasticity than the webbing material. The tensile strands may have a circular cross-section and the webbing material may have a non-circular cross-section. The tensile strands may be strategically positioned on the woven upper to aid conformance of the upper to a wearer's foot while enhancing ventilation and reducing water saturation from external factors and/or bodily fluids produced, for instance, during strenuous athletic activity. The tensile strands may permit portions of the upper to remain substantially in place during activity while simultaneously permitting portions of the upper that are void of tensile strands to move away from firm contact with the wearer's foot thus decreasing the surface area of the wearer's skin that is in contact with the upper and thereby decreasing fluid absorption and consequently the weight of the upper due to water saturation. In embodiments, the tensile strands may be grouped into bundles that collectively form a single weft or warp. The tensile strands, whether singular or bundled, may be effective for transferring a load of a fastening mechanism through the woven upper while allowing the upper to have a desired degree of elasticity, support and/or comfort.

Further, aspects of the present invention relate to a footwear upper that is formed from a plurality of tensile strands interwoven with a webbing material. The footwear upper may have a bootie configuration. At least a portion of the tensile strands may extend between a lateral-side portion of the footwear upper and a medial-side portion of the footwear upper and extend over an instep region and/or a sole region of the upper. The tensile strands may be bundled or grouped such that a plurality of tensile strands forms a single weft or warp. Bundles having differing quantities of tensile strands may form a pattern on the footwear upper that is effective for aiding conformance of the footwear upper to a wearer's foot while enhancing ventilation and reducing water saturation. The tensile strands, whether singular or bundled may be effective for transferring a load of a fastening mechanism through the woven upper while allowing the upper to have a desired degree of elasticity, support and/or comfort.

Figure 1:
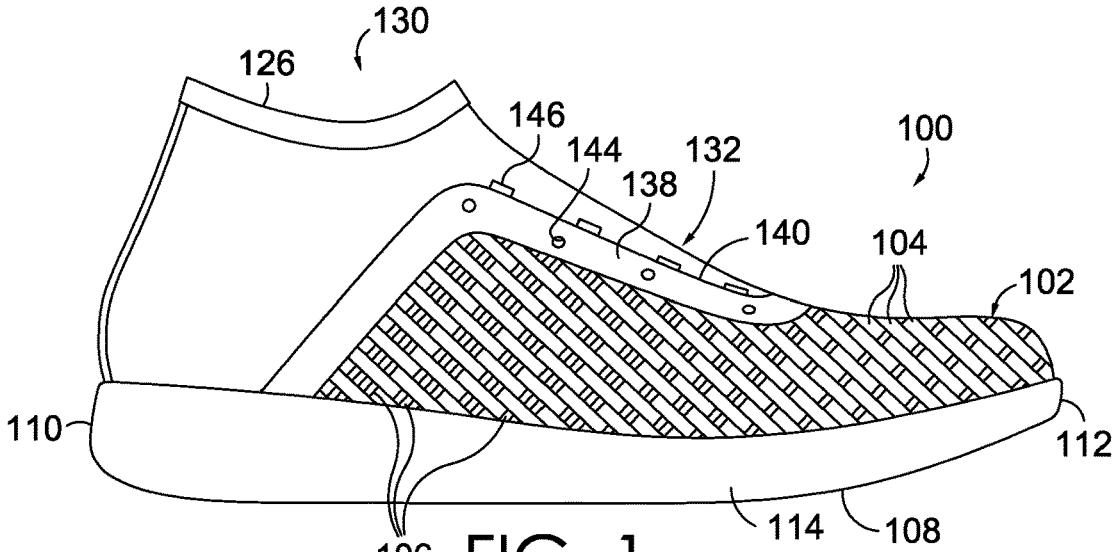
FIG. 1 depicts a lateral-side view of an article of footwear having a woven upper, in accordance with aspects of the present invention.

FIG. 1 is a lateral-side view of an article of footwear 100 (which may also be referred to as "shoe" "article," or "footwear article") having an upper 102 (which may also be referred to as "footwear upper") that includes a webbing material 104 and a plurality of tensile strands 106 interwoven at an orthogonal direction with respect to one another, in accordance with aspects of embodiments of the present invention. The construction of the article of footwear 100 of the present invention has the basic construction of an athletic-type shoe and thus may be configured for use with various kinds of footwear including, but not limited to: hiking boots, soccer shoes, football shoes, sneakers, running shoes, cross-training shoes, rugby shoes, basketball shoes, baseball shoes and the like. However, it should be understood that the novel concept of the invention could be employed on other types of footwear. Therefore, while the term "shoe" will be used herein, any type of footwear is contemplated for any purpose such that the term "shoe" should be interpreted herein as "footwear."

Because much of the construction of the shoe 100 is the same as that of a conventional athletic shoe, the conventional features of the constructions will be described only generally herein. Additionally, relative location terminology will be utilized herein. For example, the term "proximate" is intended to mean on, about, near, by, next to, at, and the like. Therefore, when a feature is proximate another feature, it is close in proximity but not necessarily exactly at the described location, in some aspects. Further, while the terms "medial" and "lateral" will be used herein for purposes of convenience, it is intended and understood that each term could be substituted for the other term. Or, in the alternative, it is understood that generic terms, such as "first" and "second" could be substituted for either medial or lateral. This substitution is, in part, to allow for a right shoe construction and a left shoe construction. Similarly, it is contemplated that some portions of the upper 102 may alternatively be coupled (either integrally or mechanically) to an opposite side.

The illustrated shoe 100 has a sole 108 that is constructed of resilient materials that are typically employed in the construction of soles of athletic shoes. The sole 108 can be constructed with an outsole, a midsole, and an insole, as is conventional. The sole 108 has a bottom surface that functions as the traction surface of the shoe, and an opposite top. The size of the shoe 100 has a length that extends from a rear sole heel end 110 to a front toe end 112 of the sole 108. The sole 108 has a width that extends between a medial side (not shown) and a lateral side 114 of the sole 108.

The upper 102 is secured to the sole 108 and extends upwardly from the sole 108, such as from the sole top surface (not shown). Generally, the upper 102 may be any type of upper. In particular, the upper 102 may have any design, shape, size, and/or color. For example, in embodiments where the article 100 is a basketball shoe, the upper 102 could be a high top upper that is shaped to provide high support on an ankle. In embodiments where the article 100 is a running shoe, the upper 102 could be a low top upper.

Figure 2A:
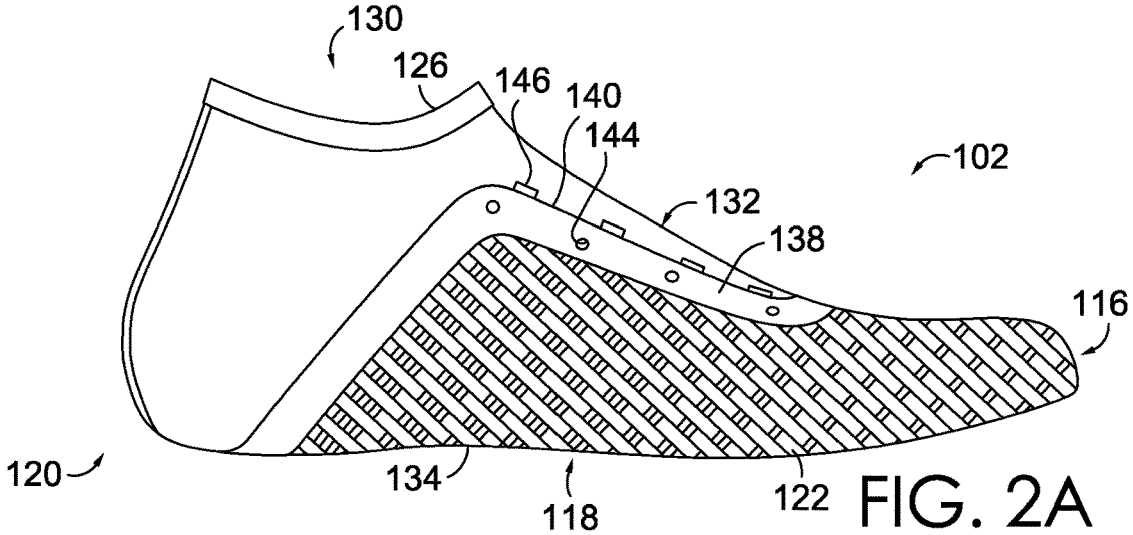
FIG. 2A depicts a lateral-side view of an upper having a webbing material interwoven with a plurality of tensile strands, in accordance with aspects of the present invention.
Figure 2B:
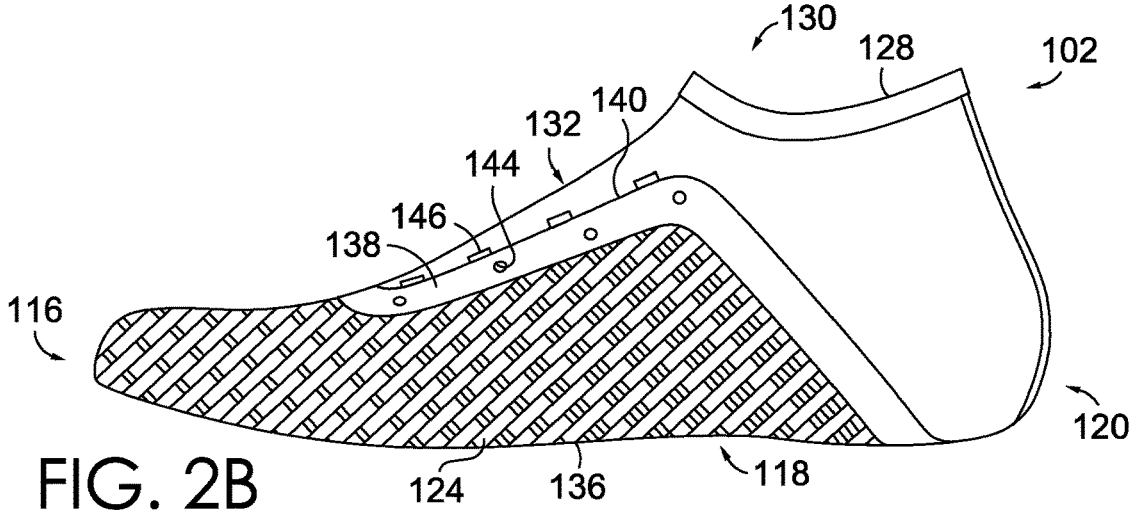
FIG. 2B depicts a medial-side view of an upper having a webbing material interwoven with a plurality of tensile strands, in accordance with aspects of the present invention.

Referring to FIGS. 2A and 2B, for purposes of reference, components of the shoe 100, such as the upper 102, may be divided into a forefoot portion 116, a mid-foot portion 118, and a heel portion 120. The forefoot portion 116 may be generally associated with the toes and joints connecting the metatarsals with the phalanges when the shoe 100 is in receipt of a wearer's foot. The mid-foot portion 118 may be generally associated with the arch of a wearer's foot. Likewise, the heel portion 120 may be generally associated with the heel of a wearer's foot, including the calcaneus bone. In addition, the upper 102 may include a lateral side 122 and a medial side 124. In particular, the lateral side 122 and medial side 124 may be opposing sides of the upper 102. Furthermore, both the lateral side 122 and the medial side 124 may extend through the forefoot portion 116, the mid-foot portion 118, and the heel portion 120.

The heel portion 120 of the upper 102 on the lateral side 122 thereof extends upwardly from the shoe sole 108 to a lateral-side portion ankle edge 126. The heel portion 120 on the medial side 124 of the upper 102 extends upwardly from the shoe sole 108 to a medial-side portion ankle edge 128. The lateral-side portion ankle edge 126 and the medial-side portion ankle edge cooperate to define an ankle opening 130. The ankle opening 130 provides access to a void on the shoe interior for receiving and securing a foot relative to the shoe 100. The void is shaped to accommodate the foot and extends along the lateral side of the foot, along the medial side of the foot, over the foot, around the heel, and under the foot of the wearer.

Although a variety of material elements or other elements may be incorporated into the upper 102, areas of one or both of the lateral side 122 and the medial side 124 may incorporate provisions to add strength and resist stretch along portions of the upper 102. As seen in FIGS. 1 and 2A, in at least one configuration, the lateral side 122 of the footwear article 100 may include a first material interwoven with a second material at an orthogonal direction with respect thereto such that wefts and warps are formed. The first material may be a webbing material. In embodiments, the webbing material may comprise a fabric woven as a flat strip that, in cross-section, is non-circular (e.g., rectangular). A woven flat strip comprised of webbing material, in embodiments, may have a width of 4 mm. Webbing material may be fabricated from a variety of fibers including, without limitation, cotton, flax, nylon, carbon, polyurethane, polypropylene, polyethylene, polyester or aramid (e.g., Kevlar®). The second material may be strands of tensile fiber ("tensile strands"). In embodiments, each tensile strand may be composed of a strong, lightweight fiber such as, by way of example only, nylon or Vectran®. The tensile strands may be fabricated such that they have a substantially circular cross-section. The tensile strands may include a tensile strength that exceeds that of a tensile strength of the webbing material and/or a modulus of elasticity that is lesser than a modulus of elasticity of the webbing material.

In embodiments, the footwear upper 102 may have a bootie configuration wherein when the upper 102 is secured to the sole 108, the primary access point for the void on the shoe interior designed for receiving and securing a foot relative to the shoe 100 is the ankle opening 130. In other words, in a bootie configuration, there is no forefoot or instep opening in the upper as is common in many articles of footwear. In such embodiments, at least a portion of the tensile strands 106 comprising the upper 102 extend from the lateral-side portion of the footwear upper 102, over the instep region 132 of the footwear upper 102, to the medial-side portion 124 of the footwear upper 102. It will be understood and appreciated by those having ordinary skill in the art that the tensile strands 106 may similarly extend from a portion of the lateral side 122 of the footwear upper 102, over the sole region (not shown) of the upper 102, to a portion of the medial side 124 of the upper 102. In embodiments, rather than extending across the instep region 132 of the footwear upper 102, at least a portion of the plurality of tensile strands 106 may instead extend from the instep region 132 of the footwear upper 102 to a lateral sole coupling portion 134 or a medial sole coupling portion 136 of the footwear upper 102. Any and all such variations, and any combination thereof, are contemplated to be within the scope of embodiments of the present invention.

Figure 4:
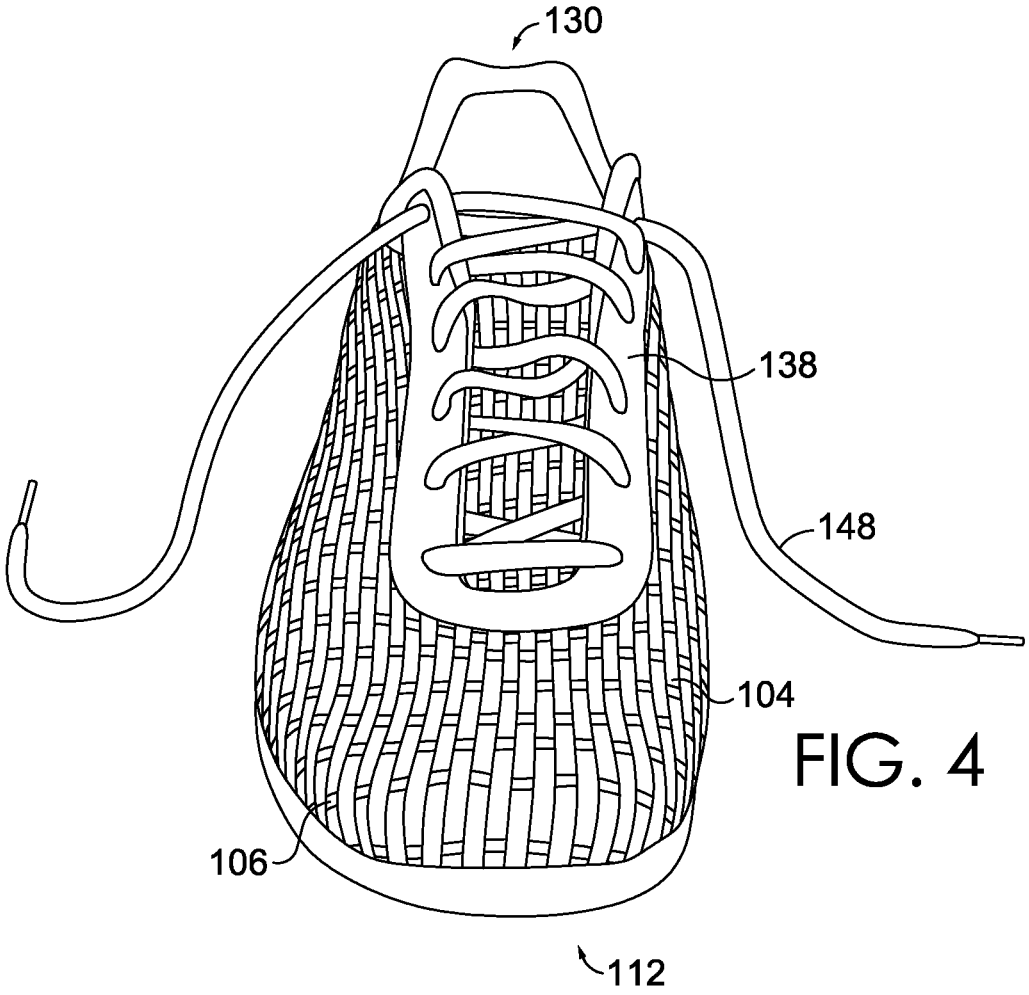
FIG. 4 depicts a toe-end view of a footwear upper having a bootie configuration and including a webbing material interwoven with a plurality of tensile strands such that at least a portion of the tensile strands extend from a lateral-side portion of the footwear upper, over the instep region of the footwear upper, and to a medial-side portion of the footwear upper, in accordance with aspects of the present invention.
Figure 5:
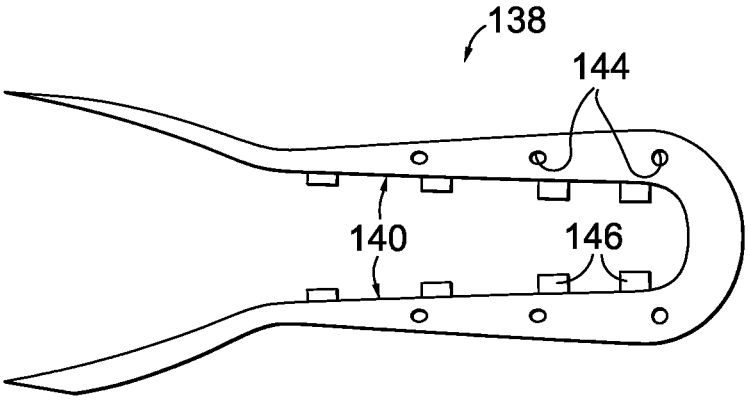
FIG. 5 is a top-down view of an overlay having a fastening mechanism that may be utilized in accordance with aspects of the present invention.
Figure 6:
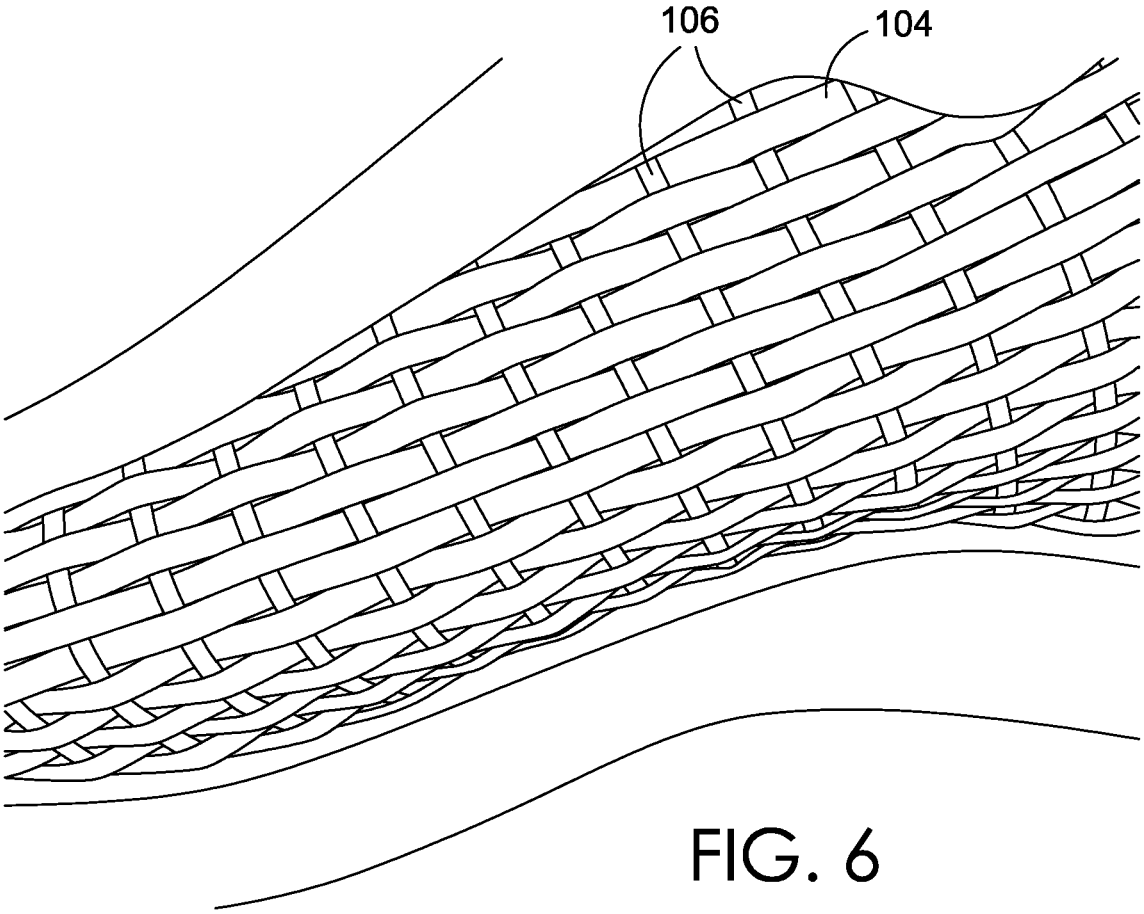
FIG. 6 depicts an exemplary portion of an upper comprised of a webbing material interwoven with a plurality of substantially evenly spaced tensile strands, in accordance with aspects of the present invention.

An article of footwear 100 in accordance with embodiments of the present invention may comprise an overlay portion 138 configured to be disposed about at least an instep region 132 of an upper 102. An exemplary overlay portion 138 is illustrated in FIG. 5. The overlay portion 138 includes an instep region boundary 140 generally configured to partially enclose an instep region 132 of the upper 102. The overlay portion 138 further includes at least a portion of a fastening mechanism 142 for securing or fastening the shoe 100 about a wearer's foot. In the exemplary overlay portion 138 of FIG. 5, the illustrated fastening mechanism 142 portion comprises apertures 144 and strand loops 146 through which a string or lace 148 (FIG. 4) is intended to pass. In embodiments, the fastening mechanism 142 permits the wearer to modify dimensions of the upper 102 to accommodate the proportions of the foot. For example, laces 148 threaded through the apertures 144 and/or strand loops 146 may permit the wearer to tighten the upper 102 around the foot and/or loosen the upper 102 to facilitate entry and removal of the foot from the void (i.e., though the ankle opening 130). In other cases, other types of fastening mechanisms may be used, such as fastening mechanisms incorporating hook-and-loop closures, buckles, or other contemplated closures. In addition, the upper 102 may include a tongue region at a top area of the footwear proximate the instep region 132.

As previously stated, interweaving of tensile strands 106 and webbing material 104 in accordance with embodiments of the present invention aids in conformance of the upper 102 to a wearer's foot while enhancing ventilation and reducing water saturation from external factors and/or bodily fluids produced, for instance, during strenuous athletic activity. That is, strategic placement of the tensile strands 106 may permit portions of the upper 102 to remain substantially in place during activity while simultaneously permitting portions of the upper 102 that are void of tensile strands 106 to move away from the firm contact with the wearer's foot thus decreasing the surface area of the wearer's skin that is in contact with the upper 102 and thereby decreasing the fluid absorption thereof. Additionally, in embodiments, the tensile strands 106 may be less absorbent than the webbing material 104. Less fluid absorption by the upper 102 may decrease the weight of the shoe 100 and permit gains in efficiency. Additionally, the tensile strands may be effective at transferring a load of a fastening mechanism through the woven upper while allowing the upper to have a desired degree of elasticity, support, and/or comfort.

In embodiments, tensile strands 106 may be interwoven with the webbing material 104 such that the webbing material 104 forms warps and the tensile strands 106 for wefts. The tensile strands 106 may be singularly interwoven with single pieces of webbing material 104 throughout all or portions of the upper 102. FIGS. 4 and 5, in particular, illustrate such embodiments. Alternatively, tensile strands 106 may be grouped together to form bundles wherein each bundle comprises multiple tensile strands 106 positioned proximate on another and comprises a single weft or warp (as appropriate). FIGS. 1, 2A, 2B and 3 illustrate embodiments wherein a portion of the tensile strands 106 are bundled.

Figure 3:
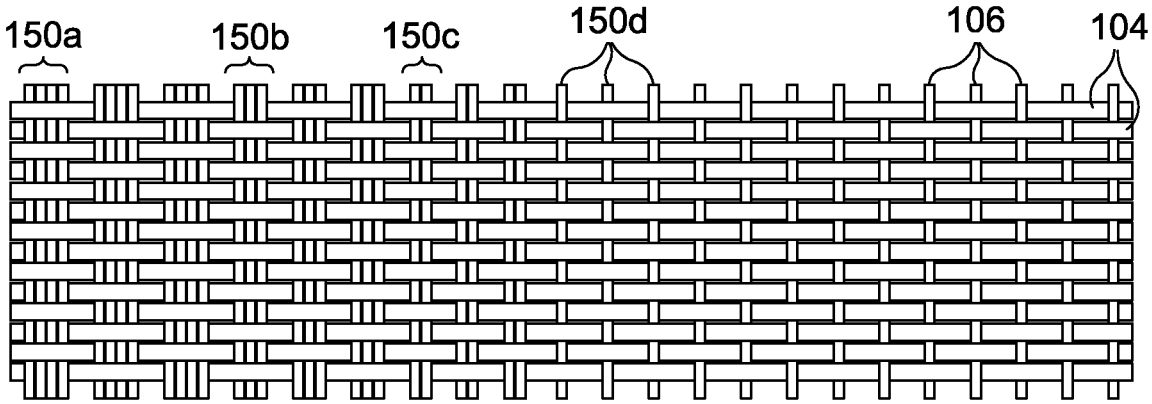
FIG. 3 depicts an exemplary portion of an upper comprised of varying bundles of tensile strands interwoven with a webbing material, in accordance with aspects of the present invention.

Referring particularly to FIG. 3, the illustrated tensile strands 106 are bundled into three bundle sizes. A first bundle size 150*a* includes four tensile strands proximate one another and forming a single weft or warp. In the illustrated example, three bundles of the first bundle size are illustrated forming three wefts or warps aligned next to one another. A second bundle size 150*b* includes three tensile strands proximate one another and forming a single weft or warp. In the illustrated example, three bundles of the second bundle size are illustrated forming three wefts or warps aligned next to one another. A third bundle size 150*c* includes two tensile strands proximate one another and forming a single weft or warp. In the illustrated example, three bundles of the third bundle size are illustrated forming three wefts or warps aligned next to one another. As illustrated, the remaining tensile strands 150*d* are singularly woven about the webbing material 104.

A pattern of tensile strand bundles as illustrated in FIG. 3 is also shown in the upper of FIGS. 2A and 2B. In FIGS. 2A and 2B, it can be seen that the tensile strand bundles of the first bundle size 150*a* are nearer to the heel portion 120 of the upper than the tensile strand bundles of the second bundle size 150*b*, and the tensile strand bundles of the second bundle size 150*b* are nearer to the heel portion 120 of the upper 102 than the tensile strand bundles of the third bundle size 150*c*. The singular tensile strands 106 are relatively furthest from the heel portion 120 of the upper 102. The illustrated configuration permits the addition of support and strength in areas of the wearer's foot where they are most beneficial during activity while providing less support in areas where it is less beneficial to the wearer. Having interwoven tensile strands 106 throughout, however, permits the additional benefit of less water absorption provided by embodiments of the present invention. The illustrated configuration additionally permits the greatest concentration of tensile strands 106 nearest the fastening mechanism such that tension may be transferring from the fastening mechanism through the woven upper while allowing the upper to have a desired degree of elasticity, support, and/or comfort.

Although the shoe construction is described above by referring to particular aspects, it should be understood that the modifications and variations could be made to the shoe construction described without departing from the intended scope of protection provided by the following claims.

The invention claimed is:

1. A woven footwear upper comprising:

a plurality of warps; and a plurality of wefts, wherein each warp of the plurality of warps in at least a portion of the woven footwear upper includes two or more tensile strands that abut one another along their entire length and follow a same weave pattern, wherein each weft includes a flat material strip having a higher modulus of elasticity than either of the two or more tensile strands, and wherein the plurality of warps continuously extend from a lateral-side portion of the woven footwear upper, over an instep region of the woven footwear upper, to a medial-side portion of the woven footwear upper.

2. The woven footwear upper of claim 1, wherein at least a portion of the two or more tensile strands extend from the instep region of the woven footwear upper to at least a sole coupling portion of the woven footwear upper.

3. The woven footwear upper of claim 1, further comprising an overlay portion disposed about at least the instep region of the woven footwear upper, the overlay portion including at least a portion of a fastening mechanism.

4. The woven footwear upper of claim 3, wherein the fastening mechanism comprises laces.

5. The woven footwear upper of claim 1, wherein the two or more tensile strands correspond to a first bundle, and wherein the woven footwear upper further comprises a second bundle of two or more tensile strands.

6. The woven footwear upper of claim 5, wherein the second bundle is positioned nearer a heel portion of the woven footwear upper than the first bundle.

7. The woven footwear upper of claim 5, further comprising a third bundle of two or more tensile strands, the third bundle having a greater quantity of the two or more tensile strands than the second bundle.

8. The woven footwear upper of claim 7, wherein the third bundle is positioned nearer a heel portion of the woven footwear upper than the second bundle.

9. A woven footwear upper having a bootie configuration comprising:

a lateral-side portion having a first ankle edge and a first lower edge;

a medial-side portion having a second ankle edge and a second lower edge; and an opening extending between the first ankle edge of the lateral-side portion and the second ankle edge of the medial-side portion;

wherein at least a portion of the woven footwear upper is comprised of:

a plurality of warps and a plurality of wefts, wherein each warp of the plurality of warps is comprised of two or more tensile strands that abut one another along their entire length, wherein each weft of the plurality of wefts is comprised of a flat material strip, and wherein a first modulus of elasticity of each of the two or more tensile strands is less than a second modulus of elasticity of the flat material strip.

10. The woven footwear upper of claim 9, wherein at least a portion of the two or more tensile strands extend from a portion of a lateral side of the woven footwear upper to a portion of a medial side of the woven footwear upper.

11. The woven footwear upper of claim 9, further comprising an overlay portion disposed about at least an instep region of the woven footwear upper, the overlay portion including at least a portion of a fastening mechanism.

12. The woven footwear upper of claim 11, wherein the fastening mechanism comprises laces.

13. The woven footwear upper of claim 9, wherein the two or more tensile strands correspond to a first bundle of tensile strands, wherein the woven footwear upper further comprises a second bundle of tensile strands, and a third bundle of tensile strands, wherein the second bundle of tensile strands has a greater quantity of the two or more tensile strands than the first bundle of tensile strands and is positioned nearer a heel portion of the woven footwear upper than the first bundle of tensile strands, and wherein the third bundle of tensile strands has a greater quantity of the two or more tensile strands than the second bundle of tensile strands and is positioned nearer the heel portion of the woven footwear upper than the second bundle of tensile strands.

14. A shoe construction comprising:

a sole;

a woven upper, the woven upper comprising:

a plurality of warps and a plurality of wefts wherein either:

each warp of the plurality of warps is comprised of a flat material strip comprising a first modulus of elasticity and each weft is comprised of one or more tensile strands, each of the one or more tensile strands having a second modulus of elasticity, wherein the second modulus of elasticity is less than the first modulus of elasticity, wherein each weft in at least a portion of the woven upper includes a plurality of bundles of tensile strands having two or more tensile strands abutting one another along their entire length; or each warp of the plurality of warps is comprised of the one or more tensile strands and each weft of the plurality of wefts is comprised of the flat material strip, wherein each warp in at least the portion of the woven upper includes the plurality of bundles of tensile strands having two or more tensile strands abutting one another along their entire length.

15. The shoe construction of claim 14, wherein the woven upper comprises a bootie construction including an opening extending between a lateral-side portion ankle edge of the woven upper and a medial-side portion ankle edge of the woven upper, and wherein the two or more tensile strands extend from a lateral-side portion of the woven upper proximate the sole to a medial-side portion of the woven upper proximate the sole.

16. The shoe construction of claim 14, wherein the two or more tensile strands correspond to a first bundle, wherein the woven upper further comprises a second bundle, and a third bundle, wherein the second bundle has a greater quantity of the two or more tensile strands than the first bundle, and wherein the second bundle is positioned nearer a heel region of the woven upper than the first bundle, and wherein the third bundle has a greater quantity of the two or more tensile strands than the second bundle, and wherein the third bundle is positioned nearer the heel region of the woven upper than the second bundle.

* * * * *